United States Patent [19]

Durì

[11] Patent Number: 5,069,056

[45] Date of Patent: Dec. 3, 1991

[54] SIMPLIFIED HYDRAULIC FORGING MACHINE

[75] Inventor: Antonino Durì, Pradamano, Italy

[73] Assignee: Danieli & C. Officine Meccaniche SPA, Pradamano, Italy

[21] Appl. No.: 609,766

[22] Filed: Nov. 7, 1990

[30] Foreign Application Priority Data

Nov. 24, 1989 [IT] Italy ..... 83515 A/89

[51] Int. Cl.[5] ..... B21D 41/00

[52] U.S. Cl. ..... 72/400; 72/418

[58] Field of Search ..... 72/404, 403, 400, 402, 72/393, 418, 394, 470

[56] References Cited

U.S. PATENT DOCUMENTS

| | | | |
|---|---|---|---|
| 2,744,428 | 5/1956 | Evans | 72/404 |
| 4,667,502 | 5/1987 | Bush et al. | 72/410 |
| 4,746,456 | 1/1989 | Schmull et al. | 72/402 |
| 4,941,342 | 7/1990 | Herndl et al. | 72/402 |

*Primary Examiner*—Lowell A. Larson
*Assistant Examiner*—Michael J. McKeon
*Attorney, Agent, or Firm*—Antonelli, Terry, Stout & Kraus

[57] ABSTRACT

Simplified hydraulic forging machine having four hammers arranged substantially symmetrically, two of the hammers below and two above a horizontal plane passing through the centre (18) of forging, the hammers (12) cooperating with a hammer support (15), the two upper hammers (12s) being stationary, whereas the two lower hammers (12) are movable.

3 Claims, 1 Drawing Sheet

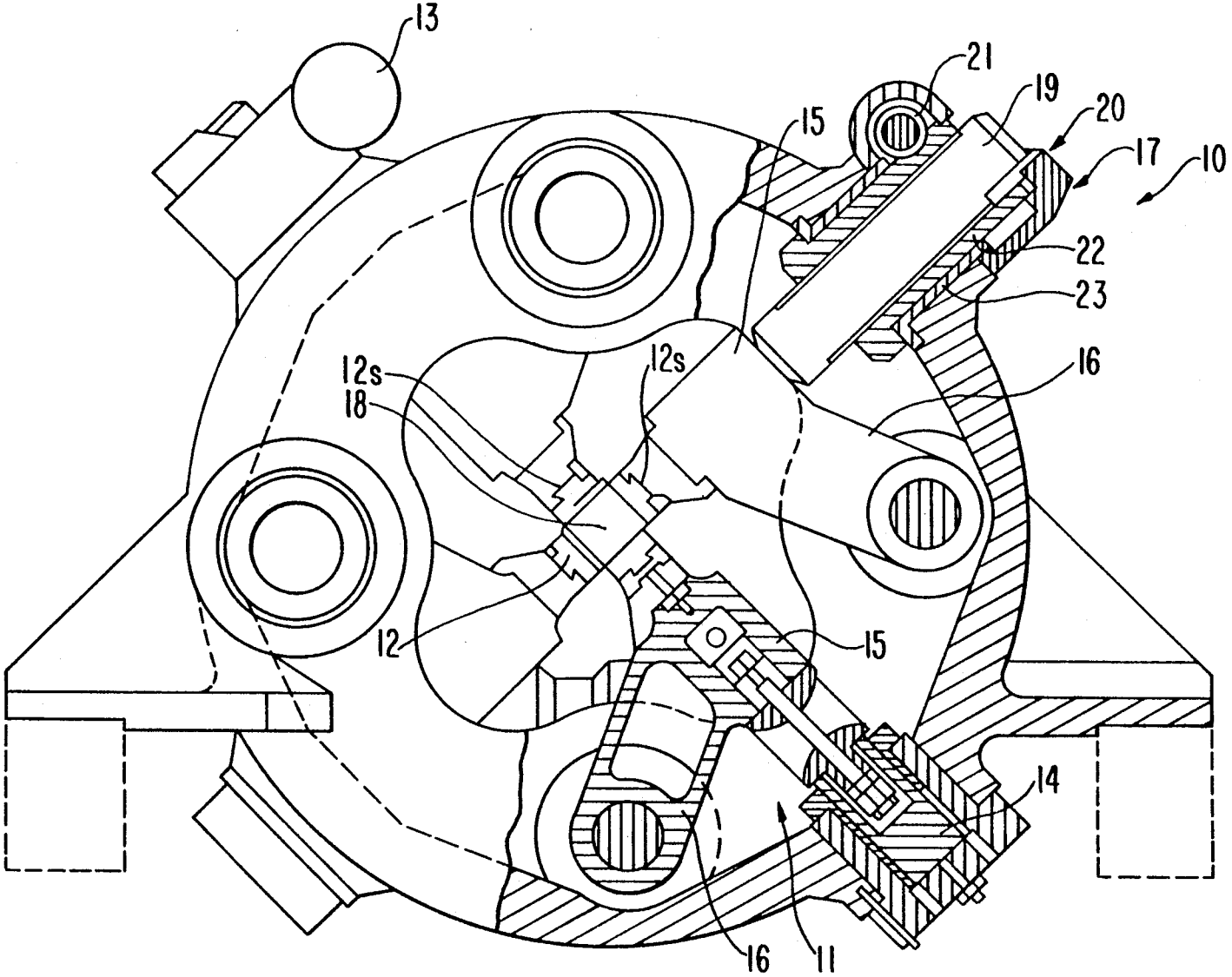
10
17
20
19
21
22
23
16
15
15
14
11
16
12s
12s
18
12
13

SIMPLIFIED HYDRAULIC FORGING MACHINE

This invention concerns a simplified hydraulic forging machine. To be more exact, the invention concerns a hydraulic forging machine comprising four hammers of which two are stationary and two are movable. All these hammers can be adjusted.

The known forging machines comprise four hammers, all of which are movable. Examples of forging machines of this type are given in EP 88108963 or in U.S. Pat. No. 4,745,793.

These forging machines are complex and extremely costly and require considerable energy for their working.

The present applicant has designed, embodied and tested the present invention so as to make a simpler and less costly forging machine which has a lower energy requirement for its working.

A simplified forging machine with four hammers according to the invention is set forth and characterised in the main claim, while the dependent claims describe variants of the idea of the solution.

According to the invention the forging machine comprises two stationary upper hammers, whereas its two lower hammers can move and perform the hammering action. The two stationary upper hammers act as anvils.

According to a variant the two stationary hammers comprise adjustment means for their better positioning and coordination.

The invention provides for the lower hammers to be movable since in this way the action of forward displacement of the product being forged is simplified.

The one single attached figure, which is given as a nonrestrictive example, shows a hydraulic forging machine 10 suitable to provide movable hammers 12 having the required movement.

The forging machine 10 comprises in each lower hammer assembly 11 a power ram 14, a hammer 12, a hammer support 15 and return-movement cylinder-piston actuation units, which are not shown in the figure. Connection and transmission means are included between the hammer support 15 and the ram 14.

The hammer support 15 cooperates and forms one single body with a lever 16.

The lower hammers 12 can be connected and actuated in any desired manner.

According to the invention the two upper hammers 12s are stationary during the hammering action and therefore the lower hammers 12 alone can move.

According to the invention the upper hammers 12s can be adjusted by an adjustment assembly 17 so that they can be correctly positioned in relation to the forging centre 18. The adjustment assembly 17 cooperates with return-movement actuation means, which in this particular example consist of a threaded abutment shaft 19.

In the example shown the upper hammers 12s too are anchored to a lever 16.

The threaded abutment shaft 19 is included in cooperation with the hammer support 15 of the lever 16 and comprises rotation-prevention means 20; it is displaced axially by a rotary sleeve 22 that rests against a bearing 23.

The rotary sleeve 22 is actuated circumferentially by a worm 21 driven by a motor 13.

The hammer support 15 cooperates with a return-movement cylinder-piston actuation unit, which is not shown in the figure.

I claim:

1. Simplified hydraulic forging machine having four hammers arranged substantially symmetrically, two of the hammers below and two above a horizontal plane passing through the center of forging, each the hammers being supported by a hammer support, the forging machine being characterized in that the two upper hammers during the forging operation are stationary, whereas the two lower hammers move to forge a workpiece during the forging operation.

2. Forging machine as claimed in claim 1, in which the upper stationary hammers can be adjusted by means of an adjustment assembly.

3. Forging machine as claimed in claim 1, further comprising two hydraulically operated power rams and connection and transmission means for connecting each hammer support of said two lower hammers to each of said two hydraulically operated power rams and for transmitting movement therebetween.

* * * * *